US006186872B1

(12) United States Patent
Kimura et al.

(10) Patent No.: US 6,186,872 B1
(45) Date of Patent: Feb. 13, 2001

(54) POLISHER

(75) Inventors: Norio Kimura; Yu Ishii, both of Kanagawa (JP)

(73) Assignee: Ebara Corporation, Tokyo (JP)

( * ) Notice: Under 35 U.S.C. 154(b), the term of this patent shall be extended for 0 days.

(21) Appl. No.: 09/485,299

(22) PCT Filed: Nov. 20, 1998

(86) PCT No.: PCT/JP98/05244

§ 371 Date: May 15, 2000

§ 102(e) Date: May 15, 2000

(87) PCT Pub. No.: WO99/26760

PCT Pub. Date: Jun. 3, 1999

(30) Foreign Application Priority Data

Nov. 21, 1997 (JP) ..... 9-338033

(51) Int. Cl.[7] ..... B24B 1/00
(52) U.S. Cl. ..... 451/53; 451/285; 451/449
(58) Field of Search ..... 451/53, 60, 285, 451/287, 446, 449, 63

(56) References Cited

U.S. PATENT DOCUMENTS 4,450,652 5/1984 Walsh .
4,471,579 * 9/1984 Bovensiepen ..... 451/53
5,113,622 * 5/1992 Nishiguchi et al. ..... 451/53
5,716,264 * 2/1998 Kimura et al. ..... 451/60
5,775,980 * 7/1998 Sasaki et al. ..... 451/60
5,873,769 * 2/1999 Chiou et al. ..... 451/53

FOREIGN PATENT DOCUMENTS 58-74040 5/1983 (JP) .
6-39704 2/1994 (JP) .
7-35015 4/1995 (JP) .

* cited by examiner

*Primary Examiner*—Derris H. Banks
(74) *Attorney, Agent, or Firm*—Wenderoth, Lind & Ponack, L.L.P.

(57) ABSTRACT

A polisher comprises a turn table having first and second end surfaces which are substantially normal to an axis of the turn table. The first end surface defines a polishing surface for polishing an article. A drive shaft is connected to the turn table in such a manner that the shaft extends along the axis of the turn table from the second end surface of the turn table. The polisher further includes a cooling system which comprises a cooling fluid path provided in the turn table for passing a cooling fluid therethrough to deprive the polishing surface of heat generated in a polishing operation and a fluid coupler provided at the center of the first end surface of the turn table for fluidly connecting the cooling fluid path with a cooling fluid supply outside of the turn table.

9 Claims, 2 Drawing Sheets

POLISHER

TECHNICAL FIELD

The present invention relates to a polisher, in particular, a polisher for polishing a semiconductor wafer, and more specifically to a system for cooling a turn table of such a polisher having a polishing surface for polishing a semiconductor wafer.

BACKGROUND ART

In the production of semiconductor devices, it is necessary to polish semiconductor wafers by means of a polisher to thereby flatten a surface thereof onto which semiconductor circuits are provided.

A typical polisher of this type includes a turn table provided with a polishing pad on an upper surface thereof, a drive shaft fixedly connected to the center of a lower surface of the turn table for drivingly rotating the turn table about its axis, a wafer carrier for holding a semiconductor wafer in contact with an upper polishing surface of the polishing pad to polish the wafer, and a slurry nozzle for supplying slurry onto the polishing surface to effect a polishing operation mechanically and chemically by a combination of the polishing pad and the supplied slurry. It is therefore desirable for a turn table of such a type of polisher to be positively cooled in order to deprive the polishing pad of heat generated in a polishing operation, although the polishing pad is cooled by the slurry to some extent. Consequently, it is conventional for such a polisher to be provided with a cooling system including a cooling fluid path extending inside of the turn table for flowing therethrough a cooling fluid received from an outside cooling fluid supply. However, since a fluid coupler provided in the cooling system to receive a cooling fluid from an outside cooling supply is conventionally located in a drive shaft which is connected to a drive mechanism for driving the shaft, the construction of a combination of the drive shaft and those devices associated with the shaft is complicated thereby causing problems of cost, maintenance and so on.

An object of the present invention is therefore to solve such problems as are involved in such a conventional polisher.

DISCLOSURE OF INVENTION

In accordance with the present invention, a polisher comprises a turn table having first and second end surfaces which are substantially normal to an axis of the turn table. The first end surface defines a polishing surface for polishing an article. A drive shaft is connected to the turn table in such a manner that the shaft extends along the axis of the turn table outwardly from the second end surface of the turn table. The polisher further includes a cooling system which comprises a cooling fluid path provided in the turn table for passing a cooling fluid therethrough to deprive the polishing surface of heat generated in a polishing operation and a fluid coupler provided at the center of the first end surface of the turn table for fluidly connecting the cooling fluid path with a cooling fluid supply outside of the turn table.

In a preferred embodiment, the turn table comprises a rotatable disc and a disc-like polishing member such as a synthetic resin polishing pad, a grindstone disc or the like axially aligned with the rotatable disc. The rotatable disc defines the above-noted second end surface of the turn table and the polishing member defies the polishing surface. The cooling system includes a cooling disc provided between the polishing member and the rotatable disc in which the above-stated cooling fluid path is formed. The cooling disc is removably connected to the rotatable disc. Alternatively, the cooling disc may be integrally formed with or integrally incorporated into the rotatable disc. The polishing member is provided with an opening at the center of the polishing member thereby exposing the center portion of the cooling disc, and the fluid coupler is mounted on the center portion of the cooling disc exposed by the opening. The fluid coupler may include a rotatable coupler body which is fixedly mounted on the center portion of the cooling disc and has a connection path fluidly connected to the cooling fluid path in the cooling disc and a stationary central member rotatably connected to the coupler body at the center of the coupler body thereby enabling the coupler body to rotate together with the cooling disc relative to the stationary central member. The stationary central member includes a fluid path having a first end port adapted to be fluidly connected to the cooling fluid supply and a second end port fluidly connected to the connecting path in the coupler body.

BEST MODE FOR CARRYING OUT THE INVENTION.

Figure 1:
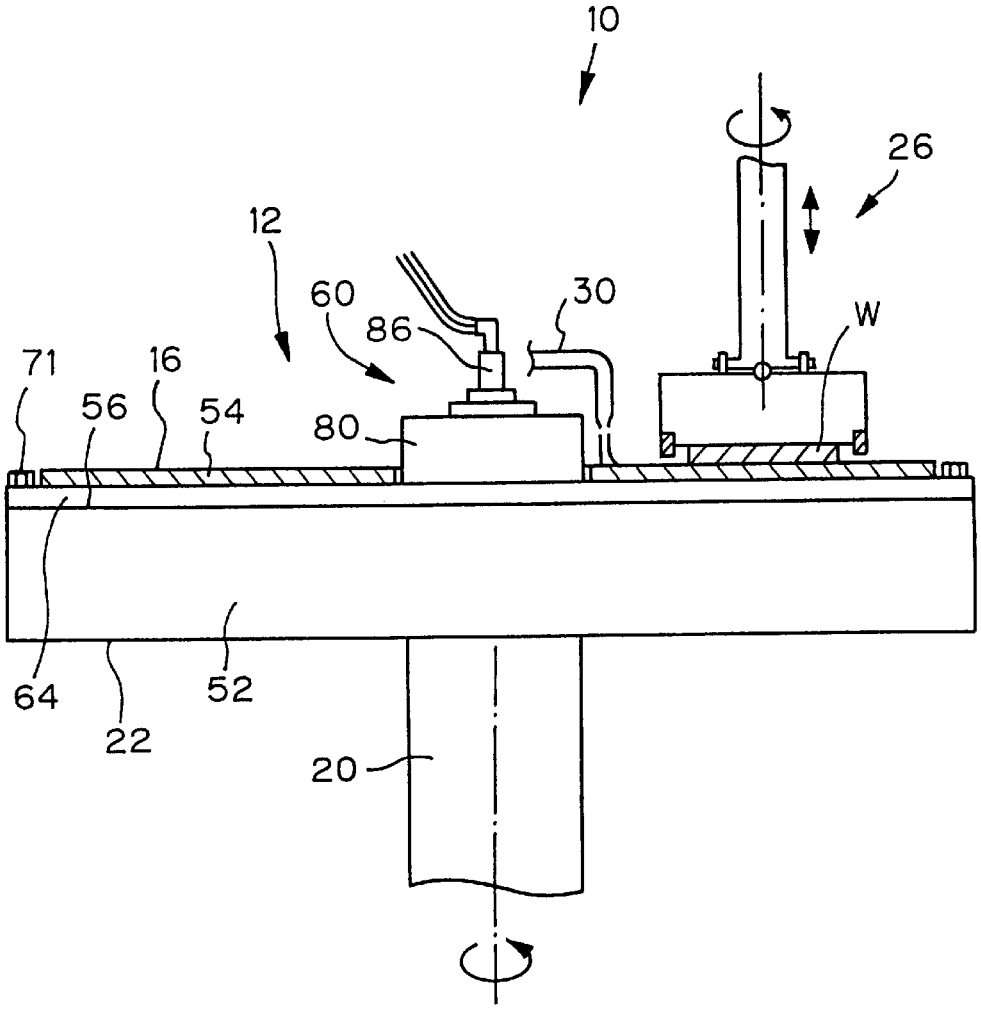
FIG. 1 is a cross sectional side elevational view of a polisher in accordance with a preferred embodiment of the present invention.
Figure 2:
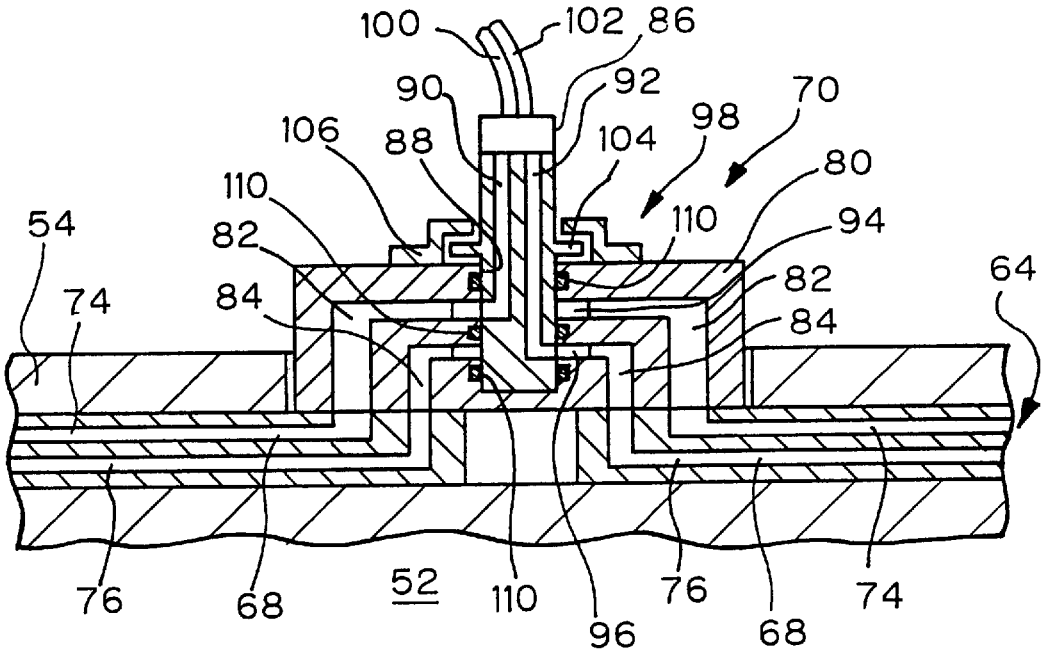
FIG. 2 is an enlarged sectional side elevational view of an important portion of a cooling system adopted in the polisher shown in FIG. 1.
Figure 3:
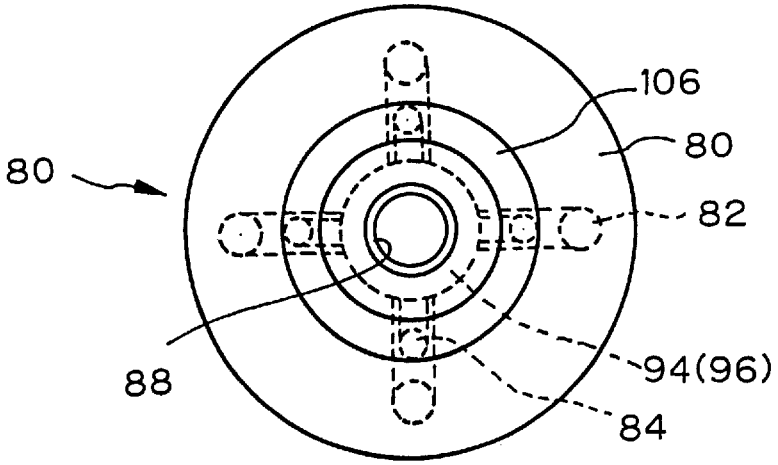
FIG. 3 is a plan view of a coupler body of the cooling system shown in FIG. 2.

A polisher 10 shown in FIG. 1 includes a turn table 12 having an upper polishing surface 16, a vertical drive shaft 20 connected to a lower surface 22 of the turn table at the center thereof for rotatably driving the turn table, a wafer carrier 26 for holding a semiconductor wafer W in contact with the polishing surface 16 and a nozzle 30 for supplying a slurry onto the polishing surface 16. As shown, the turn table 12 of the polisher 10 includes a rotatable disc 52 defining the above-stated lower surface 22 of the turn table, and a polishing member 54 such as a synthetic resin polishing pad, a grindstone disc or the like provided over an upper surface 56 of the rotatable disc 52 the upper surface of which constitutes the above-stated polishing surface 16. In operation, the turn table 12 and the wafer carrier 26 are rotated about their respective axes, while supplying a slurry through the nozzle 30, whereby the wafer is polished mechanically and chemically by a combination of the polishing surface 16 and the supplied slurry.

The polisher 10 in accordance with the present invention further includes a cooling system 60 for cooling the polishing member 54 to deprive the polishing surface 16 of a heat generated by friction between the wafer W and the polishing surface 16 in a polishing operation as stated above.

Specifically, the cooling system 60 includes a cooling disc 64 provided between the polishing member 54 and the rotatable disc 52 which cooling disc includes a cooling fluid path 68 provided therein and a fluid coupler 70 provided on the cooling disc 64 at the center thereof for fluidly connecting the cooling fluid path 68 in the cooling disc with a cooling fluid supply (not shown) outside of the turn table. The cooling disc 64 is removably fastened to the rotatable disc 52 by bolts 71 located along the periphery of the cooling disc and the polishing member 54 is adhered to the upper surface of the cooling disc. The cooling disc 64 may be integrally incorporated into or integrally formed with the rotatable disc 52.

The cooling fluid path 68 is in the form of a round-trip path and includes a plurality sending paths 74 which extend in radial directions of the cooling disc 64 and are spaced from each other in a circumferential direction of the same and a plurality of return paths 76 which also extend radially and are connected to the sending paths 74 at around the periphery of the cooling disc. As shown, the sending paths 74 are positioned closer to the polishing member 54 than the return-paths taking a cooling efficiency into consideration.

The fluid coupler 70 includes a rotatable coupler body 80 fixedly mounted on the center portion of the cooling disc 64 and having a sending connection path 82 and a return connection path 84 which are respectively connected to the sending paths 74 and the return paths 76 of the cooling disc. The coupler 70 further includes a stationary cylindrical central member 86 inserted into a vertical hole 88 formed at the center of the rotatable coupler body 80 in such a manner that the rotatable coupler body 80 can rotate about its axis together with the rotatable disc 52 relative to the stationary central member 86. The stationary central member has a sending path 90 and a return path 92 respectively adapted to fluidly connect the sending connection path 82 and the returnconnection path 84 in the coupler body 80 to the cooling fluid supply (not shown) through pipes 100, 102 connected thereto so as to form a circular path for supplying a cooling fluid from the supply to the cooling disc 64 through the sending path 90, the sending connection path 82 and the sending paths 74 and for returning the cooling fluid from the cooling disc to the cooling fluid supply through the return paths 76, the return connection path 84 and the return path 92 in order to cool the returned cooling fluid. The outlets of the sending path 90 and the return path 92 in the stationary central member are connected to the sending connection paths 82 and the return connection paths 84 through circular grooves 94, 96 formed in the inner wall of the vertical hole 88 of the rotational coupler body which are, respectively, fluidly connected to the sending connection paths 82 and the return connection paths 84 and are positioned at the same levels as those of the lower ends of the sending path 90 and the return path 92 of the stationary central member 80 facing the inner wall of the vertical hole, whereby the sending path 90 and the return path 92 of the stationary central member are always fluidly connected to the sending connection paths 82 and the return connection paths 84, respectively.

In this embodiment, a thrust bearing 98 is provided between the stationary central member 86 and the rotatable coupler body 80 which consists of a collar 104 integrally formed on the stationary central member 86 and an annular bearing member 106 fixedly connected to the top surface of the rotatable coupler body 80 to surround the collar so that the rotatable coupler body 80 can stably rotate about its axis relative to the stationary central member 86. Reference numerals 110 designate O-rings for sealing the above-stated cooling fluid paths.

As stated above, in contrast to the conventional art, in the present invention, a cooling system is provided on a polisher turn table having a polishing surface free of a drive shaft of the turn, whereby it is possible to make the construction of the cooling system simple thereby simplifying maintenance, lowering costs and so. Accordingly, this invention also makes it possible to enhance cooling of a polishing member.

Although the present invention has been explained with reference to the drawings, the entire disclosure of Japanese Patent Application Hei9-338033 filed on Nov. 21, 1997 including the specification, claims, drawings and summary is incorporated herein by reference to its entirety.

What is claimed is:

1. A polisher comprising:

a turn table having first and second end surfaces which are substantially normal to an axis of said turn table, said first end surface defining a polishing surface for polishing an article, a drive shaft connected to said turn table and extending along the axis of said turn table outwardly from said second end surface of said turn table, the drive shaft being adapted to rotatably drive the turn table, and a cooling system including a cooling fluid path provided in said turn table for passing a cooling fluid therethrough to deprive said polishing surface of a heat generated in a polishing operation and a fluid coupler provided at the center of said first end surface of said turn table for fluidly connecting said cooling fluid path with a cooling fluid supply outside of said turn table.

2. A polisher as set forth in claim 1 in which said turn table comprises a rotatable disc and a disc-like polishing member axially aligned with said rotatable disc, said rotatable disc defining said second end surface of said turn table, said polishing member defining said polishing surface, said cooling system including a cooling disc provided between said polishing member and said rotatable disc, said cooling disc being provided with said cooling fluid path therein.

3. A polisher as set forth in claim 2 in which said cooling disc is removably provided on said rotatable disc.

4. A polisher as set forth in claim 2 in which said polishing member is a polishing pad.

5. A polisher as set forth in claim 2 in which said cooling disc is removably provided on said rotatable disc and said polishing member is a polishing pad adhered to said cooling disc.

6. A polisher as set forth in claim 2 in which said polishing member is a grindstone disc.

7. A polisher as set forth in claim 2 in which said polishing member is provided with an opening at the center of said polishing member thereby exposing said center portion of said cooling disc and said fluid coupler is mounted on said center portion of said cooling disc exposed by said opening.

8. A polisher as set forth in claim 7 in which said fluid coupler includes a rotatable coupler body coaxially and fixedly mounted on said center portion of said cooling disc and having a connection path fluidly connected to said cooling fluid path in said cooling disc and a stationary central member rotatably connected to said coupler body at the center of said coupler body thereby enabling said coupler body to rotate together with said cooling disc relative to said stationary central member, said stationary central member being provided with a fluid path having a first end port adapted to be fluidly connected to said cooling fluid supply and a second end port fluidly connected to said connecting path of said coupler body.

9. A polisher as set forth in claim 8 in which said rotatable coupler body includes a through hole at the center thereof and said stationary central member is coaxially and rotatably received in said through hole of said coupler body.

* * * * *